United States Patent [19]

Turnock

[11] 4,282,807

[45] Aug. 11, 1981

[54] OFF-SET SCREEN-PRINTING MACHINE FOR DECORATING CERAMIC WARE

[75] Inventor: Frederick A. Turnock, Stoke-on-Trent, England

[73] Assignee: Service (Engineers) Limited, Stoke-on-Trent, England

[21] Appl. No.: 42,640

[22] Filed: May 25, 1979

[30] Foreign Application Priority Data

Feb. 2, 1979 [GB] United Kingdom ..... 03741/79

[51] Int. Cl.[3] ..... B41F 17/00

[52] U.S. Cl. ..... 101/41; 101/425; 101/426

[58] Field of Search ..... 101/41, 44, 217, 177, 101/150, 425, 418, 416 A, 426; 400/196.1

[56] References Cited

U.S. PATENT DOCUMENTS

| | | | |
|---|---|---|---|
| 533,186 | 1/1895 | Toye | 101/418 X |
| 2,739,529 | 3/1956 | Fernandez | 101/41 X |
| 2,842,046 | 7/1958 | Murray | 101/41 |
| 2,945,436 | 7/1960 | Van Buskirk | 101/425 X |
| 4,060,031 | 11/1977 | Philipp | 101/41 X |
| 4,088,218 | 5/1978 | De Pen | 400/196.1 X |
| 4,116,126 | 9/1978 | Milner | 101/217 |

FOREIGN PATENT DOCUMENTS

| | | | |
|---|---|---|---|
| 2013563 | 3/1971 | Fed. Rep. of Germany | 101/127 |

*Primary Examiner*—Edward M. Coven
*Attorney, Agent, or Firm*—Scrivener, Clarke, Scrivener and Johnson

[57] ABSTRACT

An offset screen-printing machine for applying a design in color to the surfaces of a succession of articles, such as articles of ceramic ware, comprising a transfer plate affording a flat, non-absorbent, surface constituting an intermediate surface, screen-printing means enabling color to be applied by a screen-printing process on to that intermediate surface, an article support for supporting an article to which the design is to be applied, a deformable transfer pad in the shape of an inverted dome, and blade means operative to scrape residual color from the intermediate surface. The machine is operable cyclically so that, in each cycle color is applied through the screen on to the intermediate surface, the color is picked up from that surface by the pad, and the color is transferred from the pad to an article supported by the article support, the blade means operating, before the application of color through the screen, to scrape from the intermediate surface any residual color remaining from the previous cycle. The blade is wiped after each scraping operation and the color from the blade recovered. The intermediate surface may be a highly finished metallic surface and the blade of, for example, nylon.

6 Claims, 2 Drawing Figures

OFF-SET SCREEN-PRINTING MACHINE FOR DECORATING CERAMIC WARE

Screen printing machines have recently been introduced into the ceramic ware industry for decorating articles of tableware, both flatware and holloware, by the direct application of colour through the screen onto the ware.

Another process which is well established for decorating such tableware is by means of an off-set printing machine comprising a deformable pad, for example of gelatine, in the shape of an inverted dome which transfers colour from an intaglio plate to the ware. The plate may be engraved or etched.

Both the foregoing processes, direct screen printing and off-set printing from an intaglio plate, offer an advantage over other, traditional, ways of decorating, for example transfer pressing and hand painting, in that, while both processes call for skill in the preparation of the screens or plates, as is also required in making transfers, they do not call for such highly skilled operatives in the pottery where the ware is decorated. The arranging of transfers on the ware, even if a machine is used to press them on rather than rub them in by hand, requires considerable skill and care.

A problem inherent in direct screen printing on articles of tableware arises from the surface contours which it is customary for such ware to assume. Direct screen printing onto a truly flat central area of a piece of so-called flatware or onto a cylindrical surface of a piece of holloware, presents no such problem, but most articles of flatware have a contoured radial profile and the walls of cups are more commonly non-uniform in diameter than uniform, and it is difficult to provide for the required deformation of the screen during application of the colour without leaving any such undesired marks as indicate whereabouts on the surface the operation of applying the colour began and finished.

Direct off-set printing from an intaglio plate by means of a deformable pad has the advantage that the decoration is uniform all over the area of the ware engaged by the pad without evident discontinuites, but the preparation of the plates from which the pad takes the colour, and which requires a high quality plating operation to ensure the surfaces can withstand the wear to which they are subject by the doctor blade, is becoming increasingly expensive compared with modern processes for preparing screens.

It has been proposed in United Kingdom Patent Specification 737461 to apply colour by screen printing onto an intermediate flat surface, and then to transfer the colour from such surface directly onto a piece of ware by means of a deformable gelatine off-set printing pad in the shape of an inverted dome, thus to obtain the advantages of screen printing to obtain the desired design in colour and of the pad to apply the colour to the ware without discontinuity. The teaching of that specification is that the intermediate surface must be non-absorbent, preferably of rustless metal or a sheet of glass although any non-absorbent flat sheet may be used, with the implication that paper would be unsuitable, at any rate unless it were non-absorbent.

An off-set screen printing process as described in said specification has not, so far as I am aware, been used industrially, and laboratory trials resulted in unsatisfactory products due to the spreading of colour and the loss of definition of the design as successive prints were obtained.

It is accordingly one of the various objects of the present invention to provide an improved off-set screen-printing process suitable, for example, for the application of designs to the contoured surfaces of articles of ceramic tableware.

It is another of the various objects of the present invention to provide an improved off-set screen-printing machine which enables successive designs in colour to be applied uniformly to the ware without significant loss of definition.

From one aspect the present invention consists in a production process for applying a design in colour to the surfaces of a succession of articles, such as articles of ceramic ware, comprising a repetitive cycle of operations in which, in each cycle, the design in colour is applied by a screen-printing process to a flat intermediate surface and is then transferred from said surface to the surface of an article by means of a deformable transfer pad in the shape of an inverted dome, the intermediate surface being scraped free, or substantially free, by blade means, of any residual colour remaining from a previous cycle, before the design is applied to it.

From another aspect the present invention consists in an offset screen-printing machine for use in applying a design in colour to the surfaces of a succession of articles, such as articles of ceramic ware, comprising a transfer plate affording a flat, non-absorbent, surface consistituting an intermediate surface, screen-printing means enabling colour to be applied by a screen-printing process on to that intermediate surface, an article support for supporting an article to which the design is to be applied, a deformable transfer pad in the shape of an inverted dome, and blade means operative to scrape residual colour from the intermediate surface, the machine being operable cyclically in such a manner that, in each cycle, first registration is effected between the screen and the intermediate surface and colour is applied through the screen onto that surface, second registration is effected between the transfer pad and the intermediate surface and colour is picked up from that surface by the pad, and third registration is effected between the article support and the pad and the colour is transferred from the pad to an article supported by the article support, the blade means operating, before the application of colour through the screen, to scrape from the intermediate surface any residual colour remaining from the previous cycle.

It is to be understood that although the invention is particularly suitable for the application of designs to non-planar surfaces of articles, it would be possible to use the invention in the application of designs to planar surfaces of articles.

The term "colour" is used herein to denote a material capable of producing a design on an article. The colour would usually have the consistency of a viscous liquid.

The intermediate surface is preferably a metallic surface, and is preferably highly finished; it may for example have a mirror-finish.

The transfer pad may be made of any material that is suitable for use with the particular type of colour and the particular type of article to which the colour is to be applied. In the decoration of ceramic ware it is usual to use transfer pads made of gelatine, though the use of pads made from silicone rubber is increasing. Both those types of pads can be used in carrying out the present invention.

The intermediate surface is preferably scraped free of residual colour by means of a blade resembling a doctor blade. The arrangement is such that the blade does not scratch the intermediate surface in use, and to this end the blade is preferably made of a softer and more flexible material than that of the surface. The blade is preferably wiped after each scraping operation. This removes colour picked up by the blade and prevents or substantially reduces the likelihood of colour adhering to the blade, setting and causing the build-up of a hard layer of colour. The wiping of the blade also reduces the likelihood of colour dropping from the blade where it is not required or where it can prevent successful operation of the process. This is particularly so where there is relative movement between the blade and the intermediate surface, between successive scraping operations, in the course of which movement the blade is disposed above the intermediate surface. The arrangement is preferably such that colour wiped from the blade can be recovered. In a preferred method, the relative movement between the blade and the intermediate surface that occurs during the scraping process is continued after the blade and surface are no longer in contact with each other, the continuation of that movement causing the blade to come into contact with a wiping member comprising a wiping edge which wipes the surface of the blade, the blade and wiper then separating from each other. Preferably any colour wiped from the blade by the wiper passes gravitationally to a reservoir from which it can be recovered, the reservoir being of a capacity great enough to accommodate colour wiped from the blade during a plurality of cycles.

In a preferred type of machine embodying the present invention the transfer pad is reciprocable vertically, while the transfer plate and the article support are on a common carriage which is reciprocable horizontally. With this construction it is possible to arrange for the first registration of one cycle, between the screen and the intermediate surface to be simultaneous with the third registration of the previous cycle, between the transfer pad and the article to which the design is applied. Further, with horizontal reciprocation of the carriage it is possible to arrange for the blade means to remain stationary during the scraping operation; where wiping means is provided this can then be provided on the carriage, between the transfer plate and the article support.

A machine embodying the present invention will now be described in more detail, by way of example only, with reference to the accompanying drawings in which.

Figure 1:
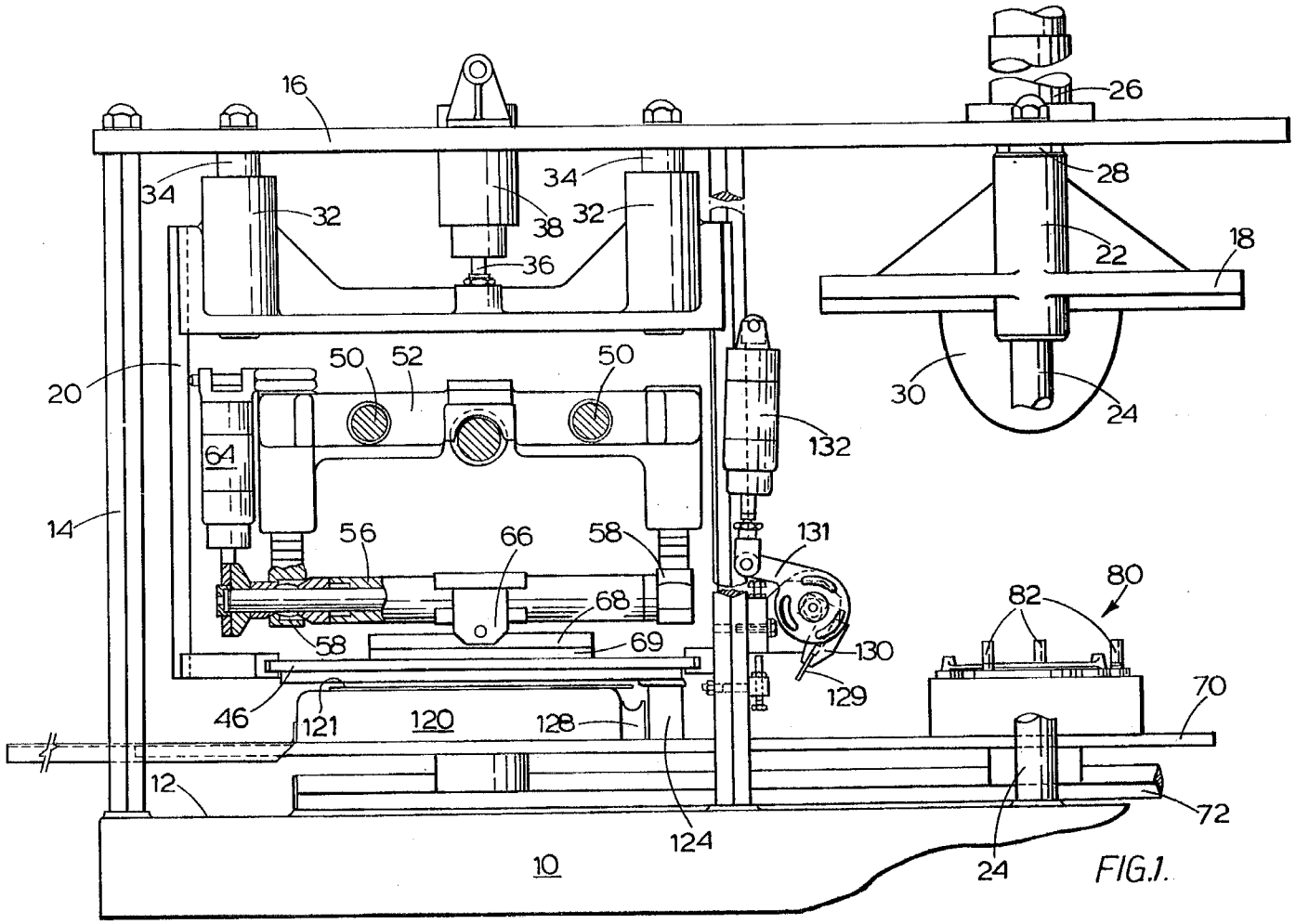
FIG. 1 is a front view of the machine.
Figure 2:
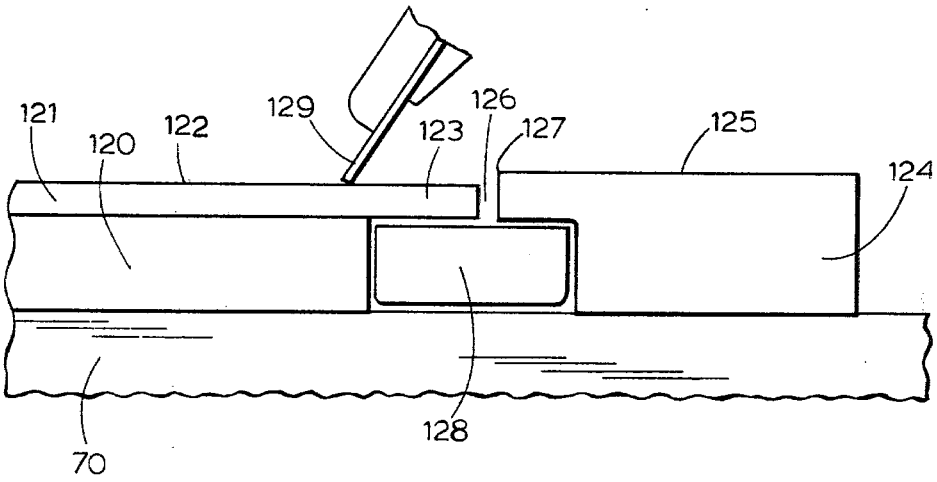
FIG. 2 illustrates part of the machine on a larger scale.

The machine comprises a frame 10 arranged to stand on the floor and having a table top 12 from which corner pillars 14 stand up to support a horizontal upper plate 16 of the frame.

A pad support 18 and screen support 20 are mounted side-by-side on the plate 16 for vertical reciprocation. Thus, the pad 18 includes two sleeve portions 22 slidable on vertical posts 24 depending from the plate 16. Mounted on top of the plate 16 is a hydraulic cylinder 26 from which a piston rod 28 projects downwardly through the plate 16 and is secured to the support 18. Mounted on a flat under surface of the support 18 is a deformable gelatine pad 30 in the shape of an inverted dome.

The screen support 20 also has two sleeve portions, 32, slidable on posts 34 depending from the under side of the plate 16. A piston rod 36 of a pneumatic cylinder 38 secured to the under side of the plate 16 is connected to the support 20. A screen, consisting of a design-bearing mesh mounted in a frame 46, is secured on the support 20 in a horizontal position.

Mounted on part of the frame 10 are two forwardly projecting horizontal guide posts 50 on which a slide 52 is carried for to-and-fro reciprocation under the influence of a hydraulic cylinder (not visible in FIG. 1). A horizontal shaft 56 is rockable about its axis in bearings 58 supported below the slide 52. A rocker arm secured to one end of the shaft 56 beyond its bearing is arranged to be actuated to rock the shaft through a small angle by a double-acting pneumatic cylinder 64. Mounted in an inclined position on the shaft 56 is a bracket 66 which carries a support 68 for a squeegee 69. The squeegee 69 can thus be raised off and lowered onto the screen by rocking the shaft 56 upon actuation of the cylinder 64.

A carriage 70 of the machine is mounted to slide horizontally from side to side on hexagonal guide bars 72. Such reciprocation is effected by a hydraulic cylinder (not visible in FIG. 1) disposed in a transverse channel of the table top 12, a piston rod of the cylinder being secured to the carriage 70.

On the carriage 70 of the machine is a ware support 80 with centering arms 82 around a vacuum holder, for centering and holding a circular piece of flatware in a conventional manner not further described herein. Also mounted on the carriage 70 is a backing plate 120, attached to its upper surface, the plate being made of any suitable material such as that sold under the Registered Trade Mark "Tufnol". Secured on top of the backing plate 120 is a transfer plate 121, of which the upper surface 122 constitutes an intermediate surface referred to hereinafter. The transfer plate is made of chromium-plated steel, and the upper surface 122 is flat, horizontal and finished to a mirror-finish. At that end of the transfer plate nearer the ware support 80 a marginal part 123 of the transfer plate projects beyond the backing plate 120 so as to leave a space between the marginal part 123 and the adjacent part of the carriage 70.

Beyond the marginal part 123 of the transfer plate there is a wiping strip 124 secured to the carriage 70. The wiping strip extends across the carriage at right angles to the direction of travel of the carriage, and its length is at least as great as the length of the adjacent marginal part 123 of the transfer plate. The height of the wiping strip is such that its upper surface 125 is slightly above the upper surface 122 of the transfer plate, and the wiping strip is so disposed that there is a narrow gap 126 between the wiping strip and the transfer plate. That edge 127 of the upper surface 125 adjacent to the gap 126 constitutes a wiping edge. Part of the wiping strip is cut away, as shown, to afford a continuation of the space beneath the marginal part 123 of the transfer plate. An open-topped tray 128 occupies that space, a central part of the tray being disposed beneath the gap 126. The tray is at least as long as the wiping strip 124 and is so mounted that it can be slid lengthwise into the space and from the space at will. A catch may be provided to secure it releasably in position.

A wiper blade 129 is provided above the transfer plate 121 to co-operate with the plate as described below. The blade may be made of nylon or of any suitable material, but is preferably made of a material softer and more flexible than those of which the transfer plate 121 and the wiping strip 124 are made. The blade 129 is mounted on a metal blade support 130 for pivotal movement about a horizontal axis at right angles to the direction of travel of the carriage 70. The blade can thus be pivoted between an operative position, as shown in the accompanying drawings, and an inoperative position in which it is inclined less steeply to the horizontal and is raised above the levels of the upper surface 122 of the transfer plate and the upper surface 125 of the wiping strip. The blade support 130 has an arm 131 secured to it. The arm is pivotally connected to the end of the piston rod of a pneumatic piston-and-cylinder unit 132. Operation of the piston-and-cylinder unit 132 rocks the arm 131 and moves the blade 129 to and fro between its operative position and its inoperative position. In its operative position the blade may conveniently be inclined at about 60° to the horizontal; it is unlikely that the blade could operate satisfactorily if in its operative position it were inclined at less than 45° to the horizontal. The blade support is mounted in a manner such as to enable it to be adjusted vertically.

It will be appreciated from the foregoing description that the blade with its associated mounting, etc. closely resembles a doctor blade of the kind used in removing colour from the top surface of an intaglio plate.

In the cycle of operation of the machine from a condition in which the transfer plate 121 is in register below the screen support 20 and a piece of ware ready to be decorated is on the support 80 in register below the pad 30 (which has colour on it which it has just picked up from the transfer plate), the cylinders 26 and 38 are actuated to bring the pad 30 down in an operating stroke to impress the design in colour onto the ware and to lower the support 20 so that an under side of the screen frame 46 bears on the upper surface 122 of the transfer plate. While the pad is executing its operating stroke, the short descent of the support 20 taking negligible time compared with the stroke of the pad support 18, the squeegee 69 is rocked down onto the screen and with movement of the slide 52 executes an operative stroke across the screen (from front to rear of the machine). The squeegee is raised and brought forward again and the support 20 is raised to lift it clear of the deposited colour. (A reservoir of colour is maintained on the screen by hand, or by automatic feed, if preferred).

The pad 30 is also raised after impressing the design on the ware, and when both screen support 20 and pad 30 are clear, the carriage 70 moves to the right hand end of its stroke to a position in which the transfer plate 121 is in register with the transfer pad 30. During that movement of the carriage the wiper blade 129 is in its inoperative position. The ware support 80 is now in a loading and unloading position where the piece of ware bearing the design is replaced by a fresh piece, either by hand or automatically. The pad 30 is now lowered and raised again (while the screen support 20 remains up) to pick up colour from the transfer plate. The carriage next returns to the left (as seen in FIG. 1). Throughout that return movement the blade 129 is maintained in its operative position. The blade acts to scrape any remaining colour from the upper surface 121 of the transfer plate. Although a trace of colour may remain on that surface, the amount remaining is too small to effect adversely the next cycle of operation. As the blade scrapes the surface, the colour from the surface builds up to form a ribbon of colour on the blade adjacent to the lower edge of the blade. During the final stages of return movement of the carriage the transfer plate 121 passes beyond the blade, and the blade is immediately engaged by the wiping edge 127 of the wiping strip 124. That edge 127 engages the blade sufficiently far above the lower edge of the blade to ensure that the ribbon of colour on the blade lies wholly below the wiping edge. Continued movement of the carriage causes the ribbon of colour to be wiped from the blade onto the end face of the wiping strip below the wiping edge 127 and bordering the gap 126. When the carriage reaches its left hand end position the blade is raised from the upper surface 125 of the wiping strip to its inoperative position.

The transfer pad 30 is lowered and raised again to transfer the design to an article of ware on the ware support 80, while the screen-printing means operates again to apply the design in colour to the transfer plate 121, and the cycle continues as described above.

The colour is in the form of a viscous liquid, so that when the ribbon of colour is wiped from the blade it flows downwards through the gap 126 and drops into the tray 128. The rate of flow is such that there is no build up of colour immediately beneath the wiping edge 127. Before the tray becomes full it can be removed and emptied, the colour thus recovered being used again in the process.

The machine thus enables designs to be printed reliably and uniformly on successive pieces of ware by screen printing without discontinuity of the design itself and with few interruptions in the output of production.

I claim:

1. An off-set screen-printing machine for use in applying a design in colour to the surfaces of a succession of articles, such as articles of ceramic ware, comprising a transfer plate affording a flat, non-absorbent, highly finished surface constituting an intermediate surface, screen-printing means enabling a design in colour to be applied by a screen-printing process on to that intermediate surface, an article support for supporting an article to which the design is to be applied, and a deformable transfer pad in the shape of an inverted dome enabling the design in colour to be transferred from the intermediate surface to an article on the article support, the machine being operable cyclically in such a manner that, in each cycle, first registration is effected between the screen and the intermediate surface and colour is applied through the screen on to that surface, second registration is effected between the transfer pad and the intermediate surface and colour is picked up from that surface by the pad, and third registration is effected between the article support and the pad and the colour is transferred from the pad to an article supported by the article support, the machine comprising also plate cleaning means for removing from the intermediate surface, before the application of colour through the screen each cycle, any residual colour remaining after the design in colour has been transferred by the transfer pad from the surface to an article on the article support in the previous cycle, said cleaning means comprising a wiper blade mounted to engage the transfer plate with the blade extending across the intermediate surface, means operative to cause relative movement between the blade and the plate with the blade in engagement with said intermediate surface so that the blade sweeps the surface to remove any residual colour therefrom, blade wiping means, and means operative to cause relative movement between the blade and said wiping means with the blade in engagement with the wiping means so that the wiping means wipes the blade to remove from the blade colour previously removed by the blade from the plate.

2. A machine according to claim 1 in which said wiping means comprises a wiping member secured adjacent the transfer plate with a wiping edge of the member positioned slightly above the level of the intermediate surface to engage the blade after the blade has left the intermediate surface.

3. A machine according to claim 2 in which there is a gap between the transfer plate and the wiping member and collecting means is arranged beneath the gap to collect colour wiped by the wiping edge from the blade.

4. A machine according to claim 1 in which the intermediate surface is a metallic surface.

5. A machine according to claim 1 in which the blade is made of a softer and more flexible material than that providing the intermediate surface.

6. A machine according to claim 5 in which the intermediate surface is a metallic surface and the blade is of a nylon material.

* * * * *